United States Patent [19]

Hodne

[11] 4,453,840

[45] Jun. 12, 1984

[54] ACTUATOR FOR A PRINT WIRE

[76] Inventor: Ingard B. Hodne, 4048 Sunset La., Northbrook, Ill. 60062

[21] Appl. No.: 447,148

[22] Filed: Dec. 6, 1982

[51] Int. Cl.[3] ..... B41J 3/12

[52] U.S. Cl. ..... 400/124

[58] Field of Search ..... 400/124

[56] References Cited

U.S. PATENT DOCUMENTS

| | | | |
|---|---|---|---|
| 2,882,368 | 4/1959 | Sauer | 335/203 |
| 4,051,941 | 10/1977 | Hebert | 400/124 |
| 4,222,674 | 9/1980 | Mori et al. | 400/124 |
| 4,230,038 | 10/1980 | Hebert | 400/124 |
| 4,230,412 | 10/1980 | Hebert | 400/124 |
| 4,236,836 | 12/1980 | Hodne | 400/124 |
| 4,240,756 | 12/1980 | Ku et al. | 400/124 |
| 4,252,449 | 2/1981 | Miyazawa et al. | 400/124 |
| 4,279,521 | 7/1981 | Kightlinger | 101/93.05 |
| 4,407,591 | 10/1983 | Adamoli et al. | 400/124 |

*Primary Examiner*—Edgar S. Burr
*Assistant Examiner*—M. J. Hirabayashi
*Attorney, Agent, or Firm*—John D. Kaufmann

[57] ABSTRACT

A matrix print head operates 24 or more print wires to produce high quality characters. The head includes multiple levels, each of which contains common parts. Each level has a cup-shaped magnet frame, the bottom of which mounts poles. Around each pole is a bobbin-wound coil located via a tab on the bobbin which is held in a slot in the side wall of the magnet frame. An armature with a wide base and a narrow finger is associated with each pole. Each base pivots on a bevel edge formed in the side wall of the frame causing the finger to move a print wire. Posts on the bobbin extend through the holes in each armature to locate it on its pivot edge. The side wall of the frame and the armatures are configured so that only those portions capable of effectively contributing to moving the armatures are given substantial mass and size. Return force is applied to the armatures by a tensioned elastomeric band acting between the armature bases and a beveled surface spaced from the armatures. Each armature has its non-print position set by abutting an angled elastomeric member. The beveled surface for the band and a mounting surface for the elastomeric member may be provided by the same element, such as the facing portion of an adjacent level or a back plate.

20 Claims, 12 Drawing Figures

12P
12P
14
108
104
106
92a
12D
90
88
106
108
108
106
108
106
104
106
108
108
102
100
92b
12D
90
88
102
100
102
96
98
92c
12D
98
88
96

ACTUATOR FOR A PRINT WIRE

BACKGROUND OF THE INVENTION

1. Field of the Invention

The present invention relates to an improved actuator for a print wire of a dot matrix printer, and, more specifically, to a plurality of such actuators conveniently associated together in an improved print head for a dot matrix printer. The present invention constitutes an improvement of the dot impact printer and actuator described in U.S. Pat. No. 4,236,836, issued Dec. 2, 1980 in the name of Hodne, and is particularly intended to provide a print head for a dot matrix printer having the capability of operating eighteen, twenty-four or more print wires in a dense pattern which can print high quality, easily readable printed characters, with descenders and ascenders, without the need for the print head to be moved in multiple passes over a printing medium.

1. Brief Description of the Prior Art

Dot matrix printers and print heads therefor are well known in the prior art. Typically, such printers include a plurality of elongated print wires, eachof which is longitudinally, ballistically movable to a print position whereat an end thereof is impacted against an inked ribbon held adjacent to a print medium, such as a sheet of paper, to print a dot thereon. The wires are selectively moved in various combinations so that legible indicia (characters, such as letters, numbers and symbols) made up of patterns of the dots are printed on the paper. In typical prior art matrix printers, each wire is selectively movable between a non-print position and the print position by an armature which is pivoted in response to selective energization of an electromagnet from a pole face of which the armature is normally separated by an air gap. Each armature bears against the end of its associated wire which is opposite the end which effects the printing. The print wires and their actuators—the armatures and the electromagnets—are associated together in an array in the print head which is movable back and forth across the paper as the wires are selectively moved. As is well known, the printing of high quality characters may require multiple passes of the print head across a single "line" of the paper. In order to eliminate such multiple passes of the print head, the number of wires in the matrix print head must be increased. See, for example, "Wire-Matrix Advances Fuel Rise of Impact Printers" in the Aug. 16, 1980 issue of *Electronic Design* and "18-Wire Print Head—Fast and Good Enough to be Multipurpose" on page 35 of the Sept. 27, 1980 issue of *Electronic Design.*

The distance each armature must pivot or travel is critical to the performance of the print head, as this distance affects the speed of operation of the print head, the printing energy of the print wires, and the electrical power requirements of the electromagnets. Armature travel must, therefore, be accurately controlled and must be uniform for each actuator in the print head. Excessive variation of armature travel due to cumulative manufacturing tolerances is a well known problem in the prior art. To date, it has, accordingly, been necessary to provide facilities for adjusting the limit of the travel of each armature in the print head. Such adjustment has typically been effected by causing armature to abut a back-stop in its nonprint position. The back-stop may include an adjustable set screw or a piece of resilient material, the position or thickness of which is adjusted for each armature to appropriately set its nonprint position. The provision of such back-stops is both complex and costly, and attempts have been made to simplify or eliminate them. See, for example, U.S. Pat. No. 4,222,674 where strict control of critical dimensions is said to eliminate the need for adjustable armature back-stops. Nevertheless, variations of the gaps between each armature and the pole face of its electromagnet may be rather large and likely to have an adverse effect on the uniform performance of each actuator of the print head. Thus, one object of the present invention is the provision of an improved matrix print head in which precise and uniform travel of each armature is achieved without the need for back-stop adjustment.

Back-stops usually include a resilient rubber or plastic material which tends to damp and minimize the rebound of the armatures as they impact thereagainst following pivoting to their print positions. The back-stops of the prior art have the disadvantage that the area of contact between them and the armatures is relatively small, as is the case where the back-stop is a rubber pad on the end of an adjustable set screw. In this event, the deflection of the back-stop upon impact of an armature thereagainst is relatively large, and, consequently, a large rebound of the armature may occur. Armature rebound is a problem in that it leads to erratic armature motion, reduced speed of armature operation, and inability to rapidly print. Thus, another object of the present invention is an improved print head in which the armatures impact against a back-stop over a large area, thereby reducing the deflection of the back-stop to significantly reduce the rebound of the armatures, leading to improved performance.

The head portion of the dot printer disclosed in the '674 patent includes a plurality of actuators for selectively moving a plurality of wires to produce printed characters. In theory, the print head could be constructed to actuate eighteen, twenty-four or a greater number of print wires. Nevertheless, the structure of the print head disclosed in the '674 patent is quite complicated in structure and rather expensive to manufacture. It should be noted that the '674 patent discloses a cup-shaped yoke which mounts a plurality of iron cores. The cores are mounted to the bottom of the cup-shaped yoke in a circular array. Each core is surrounded by a bobbin, around each of which is wound an electric coil. Armatures of the print head are each pivoted on a rather complicated structure formed integrally with the bobbin and are attracted toward the print position by the yoke and the cores when the coils are energized. The present invention relates, in part, to an improvement of and a simplification in the yoke-core structure of the '674 patent, in order to more effectively move the armatures and to improve and simplify the structure of the bobbins, while simplifying, and decreasing the cost of, the assembly and operation of the print head.

The above-referenced '836 patent describes an improved actuator for a dot matrix printer. Theoretically, any desired number of such actuators could be associated in a print head to selectively actuate eighteen, twenty-four or more wires to produce high quality print. However, as the patent is spcifically concerned with improvements in the actuator itself, and not with techniques of conveniently assemblying together a number of actuators, no specific means for conveniently and inexpensively associating a number of actuators together in a print head is disclosed therein.

U.S. Pat. No. 4,230,412 relates to a matrix print head assembly. In this patent, armatures are centrally supported between their ends on an inner pole piece. In order to pivot the armatures to actuate their print wires, an electronmagnetic coil surrounding an outer pole piece (which is adjacent an outer end of each armature) is actuated to attract such outer end. This attraction pivots each armature on its inner pole piece, pivoting its inner end to longitudinally move its associated print wire. Each armature is maintained in a normal, non-print position by an O-ring maintained in a groove which is pushed against the armature between its pivoting point on the inner pole piece and its point of engagement with the print wire. The present invention relates to an improvement of this structure, wherein the armature is more efficiently and simply held and maintained in its non-print position and wherein construction of the print head is rendered more convenient.

U.S. Pat. No. 2,882,368 relates to an electromagnetic relay. Certain principles of this patent are preferably incorporated into the actuator of the present invention. The '368 patent relates to increasing and more efficiently utilizing the force exerted on an armature by appropriate configuration of pole faces and a core associated with the armature, as hereinafter described.

Similarly, the present invention constitutes an improvement and simplification of the wire matrix print head depicted in U.S. Pat. No. 4,279,521.

Prior art dox matrix printers are generally known in the prior art for their simplicity of design, their reliability, their high speed of operation, and their low cost. A major limitaion has, however, been the inferior print quality, stemming from the relatively small number of dots making up the printed characters. Print quality is directly related to the number of print wires used in the print head, which typically has been limited to seven or nine. A principal object of the present invention is to obtain a significant improvement of the print quality achievable by a matrix print head by conveniently and inexpensively doubling or tripling the number of print wires therein. Further, by reducing the diameter of the print wires so the printed characters can be constructed from a larger number and a higher density of small dots, the print quality can be improved to approach the high quality of a typewriter. The high dot density will improve the graphics capability of the printer, provide more freedom and flexiblity in the design of character fonts, and generally help to realize the full potential of matrix printing technology.

As the number of print wires in the matrix print head increases, assembly of the print head becomes more difficult. It is desirable to hold to a minimum and to simplify the number of steps of such assembly so as to minimize the ultimate cost of the print head. It is also desirable to minimize critical adjustments in, and critical assembly operations of, a multiwire print head. These are additional objects of the present invention.

SUMMARY OF THE INVENTION

With the above and other objects in view, the present invention comtemplates an actuator for a print wire. The print wire has a driven end and a printing end and is movable between non-print and print positions by the actuator.

The actuator comprises a ferromagnetic magnet frame, which includes a bottom wall, a side wall extending away from the bottom wall, and a ferromagnetic pole extending away from the bottom wall in the same direction as the side wall. The walls and the pole may be unitarily formed or may be attached together. The side wall has a pair of inward extensions which extend along the bottom wall away from the side wall and towards points to either side of the pole. The thickness of the inward extensions varies along a direction generally perpendicular to the side wall so that inward extensions each have a lateral surface so shaped that a cavity is produced between the pole and the extensions. The wall of the cavity is at all points substantially equidistant from the pole. The side wall has a top planar surface which is co-planar with the top face of the pole and with the top surfaces of the extensions. The top planar surface of the side wall is formed with a bevel at that part of its outer edge which is or comprises the thinnest portion of the inward extensions. The innermost part of the bevel amd the surface of the side wall define a pivoting edge.

A planar, ferromagnetic armature, having opposed first and second surfaces, has a wide base and a substantially narrower finger which is abuttable with the driven end of the print wire for movement thereof. The pivoting edge defines a pivot line about which the base of the armature is pivotable between a non-print and a print position with the finger to the inside of the pivoting edge. The first surface of the base of the armature is pivoted on the pivoting edge so that the first surface overlies the co-planar surfaces of the side wall and the extensions, as well as the pole face. That portion of the first surface of the armature inward from the pivoting edge is separated from the co-planar surfaces and from the pole face in the non-print position of the armature and contacts the co-planar surfaces and the pole face in the print position of the armature.

The actuator also includes an insulative bobbin having a selectively energizable electric coil thereon, both of which surround the pole and are generally conformally held in the cavity. Also included are facilities for holding the first surface of the armature at the base against the pivoting edge and facilities for biasing the armature to its non-print position.

Due to the above construction, energization of the coil pivots the armature on the pivoting edge against the biasing facility due to the attraction of the armature by the co-planar surfaces and the pole face. This effects movement of the finger and of the driven end of the wire so that the printing end of the wire is impacted against a printing medium. The configuration of the extensions serves to maximize the effect of the attractive force on the armature by maximizing the size of the co-planar surfaces overlain by the armature while minimizing the size of the surface of the side wall in the vicinity of the pivoting edge.

In preferred embodiments, the holding facilities and the biasing facilities together include a beveled surface angularly related to the armature and spaced from a second surface of the armature of the base. A tensioned, elastomeric band is trapped between the beveled surface and the second surface of the armature at the base so that the band contacts the second armature surface at the base and to the outside of the pivoting edge. The tension in the trapped band effects the application of a resultant force generally normal to the second surface to normally hold the armature in its non-print position and to return the armature to its non-print position after it is pivoted by energization of the coil.

In other preferred embodiments, a resilient member is provided which is abutted by the second surface of the armature at the finger to set the non-print position of the armature. Preferably, the resilient member comprises an elastomeric member having a slanted surface abutted by the second surface of the armature in its non-print position. In specific preferred embodiments, the beveled surface which coacts with the elastomeric band is formed on a supporting surface which mounts the resilient member.

In further preferred embodiments, a notch is formed in the thinnest portions of the extensions, and the bobbin includes a locating tab which is held in the notch. The positioning of the tab in the notch locates the bobbin in its cavity and prevents movement of the bobbin therein. The bobbin also preferably includes facilities for preventing relative movement between the bobbin and the armature, other than the pivoting of the armature on the pivoting edge. This preventing facility may comprise a pair of posts on the bobbin and a pair of holes through the armature. Each hole engages one of the posts on the holes and the action of the notch on the tab prevent relative motion among the bobbin, the armature, and the magnet frame, except for the pivoting of the armature on the pivoting edge. Preferably, the surfaces of the armature are symmetrical and the holes therethrough and the posts lie on the axis of symmetry with one hole and one post being closer to the edge than the other hole and post. The pivoting edge is preferably normal to the axis of symmetry. Further, the hole through the armature which is farther from the pivoting edge to the inside thereof is preferably elongated to permit pivoting of the armature on the pivoting edge.

In more specific embodiments of the present invention, a plurality of the above-described actuators for moving a plurality of print wires are associated together in a print head level. Each of the armatures in the level is associated with a magnet frame, a bobbin, a coil, a holding facility, and a biasing facility. The magnet frames are integral, or attached together, and form a common cup-shaped magnet frame having a common bottom wall, a continuous integral side wall, and a plurality of the extensions, with adjacent armatures overlying or contacting (depending on their positions) shared extensions therebetween. The cavities associated with each armature are continuous with each other and form a main cavity within the cup-shaped, common magnet frame. The main cavity communicates with a central aperture formed in the common bottom wall and the fingers of the armatures overlie the central aperture in a spaced array thereabout. The print wires extend through the central aperture into abutment with respective fingers of the armatures.

In the print head level the beveled surface is spaced from the second surfaces of all armatures therein, and the band is continuous and is trapped between the beveled surface and the second surfaces of the armatures at their bases. Further, the resilient member may be a continuous member having segments angularly related to the print positions of the armatures to set the non-print position of each.

The present invention also contemplates a print head which includes a plurality of the above-described print head levels. Facilities are provided for mounting the levels together with their central apertures aligned. The print wires of each level pass through and along one or more of the aligned central apertures. Except for the level farthest from the printing ends of the print wires, the supporting surface for each resilient member, and the surface defining each bevel for each elastomeric band, constitutes the exterior of the common bottom wall of the next adjacent level farther from the printing ends of the print wires. A back plate faces the level farthest from the printing ends. The back plate contains a supporting surface and a beveled surface for the elastomeric member and the tensioned band associated with the armatures of the farthest level.

Figure 1:
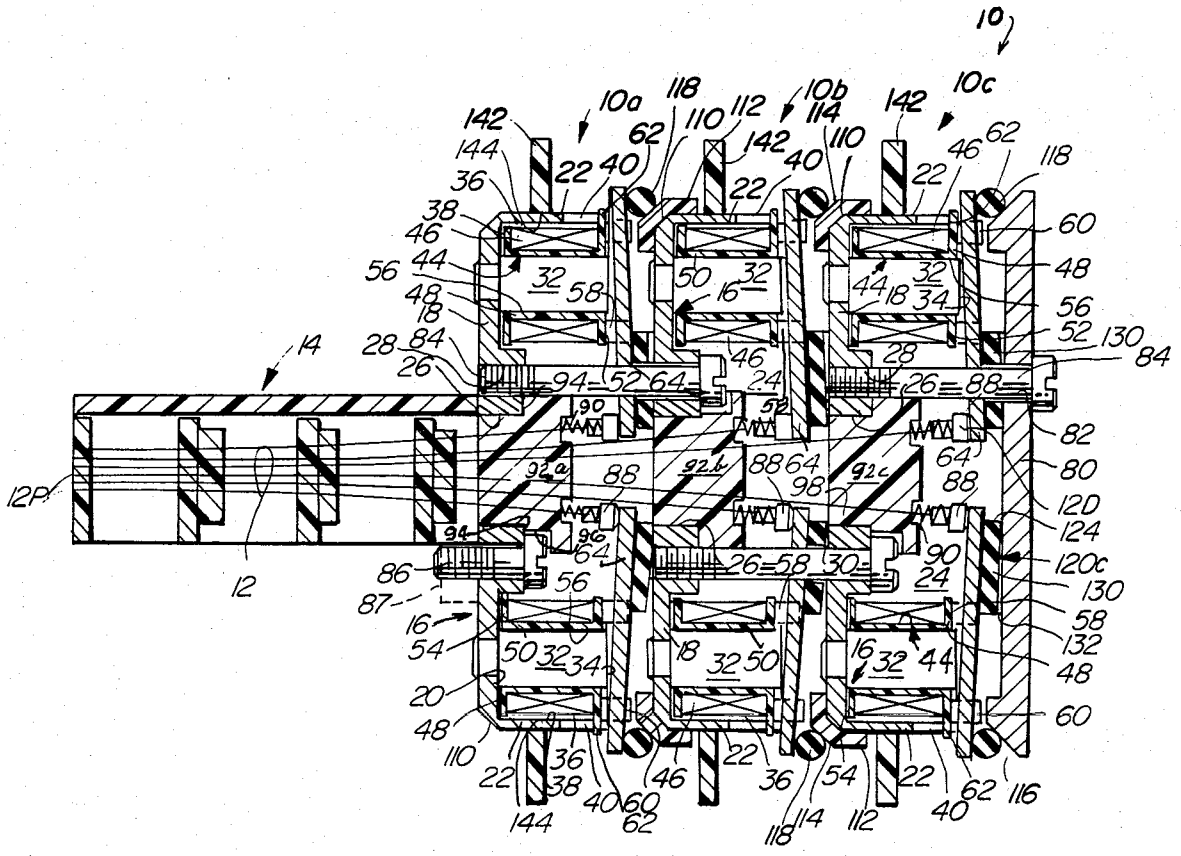
FIG. 1 is a partially sectioned, side elevation of a dot matrix print head according to the present invention.
Figure 2:
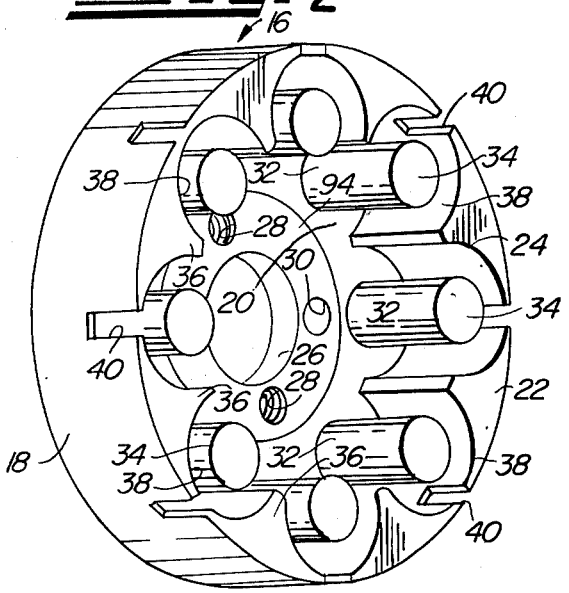
FIGS. 2 and 3 are, respectively, a top and a bottom perspective view of a magnet frame forming a portion of the print head of FIG. 1.
Figure 3:
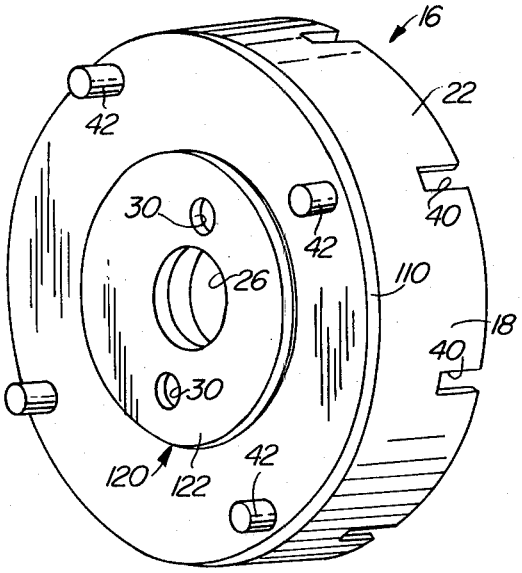
Figure 5:
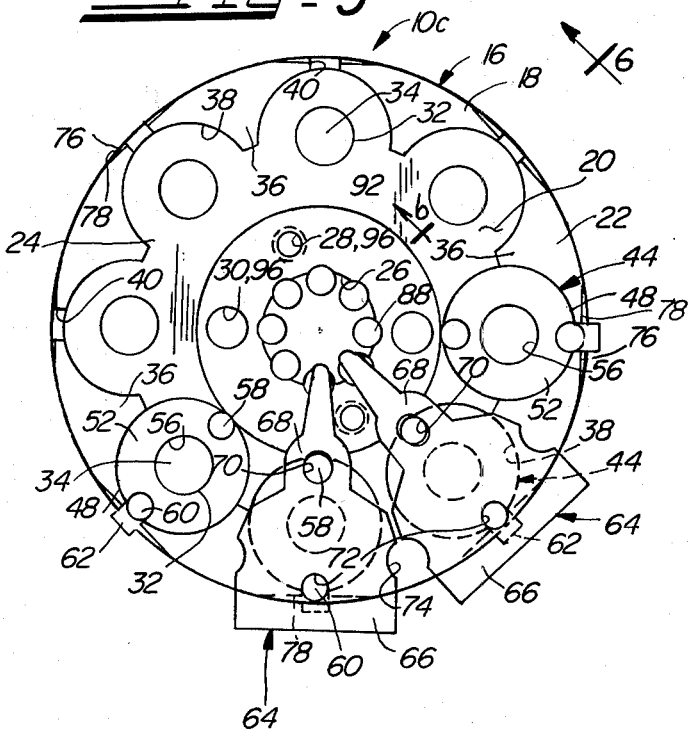
FIG. 5 is a plan view of the magnet frame depicted in FIGS. 2 and 3 depicting the manner in which the bobbins and coils of FIG. 4 and armatures of the print head are assembled thereon.
Figure 8:
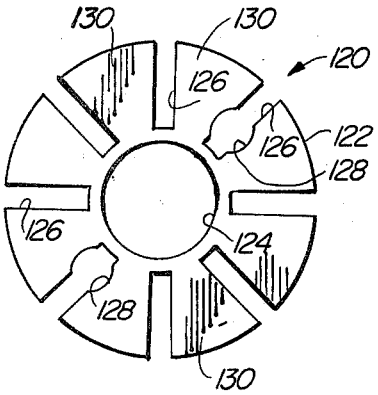
Figure 9:
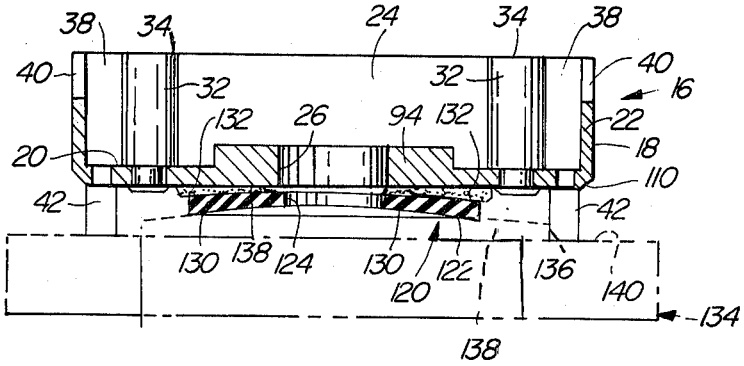
Figure 10A:
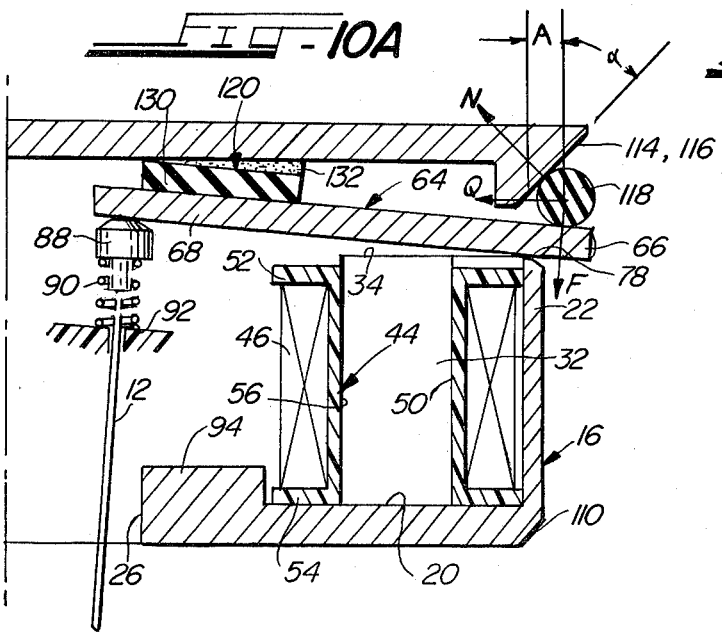
Figure 10B:
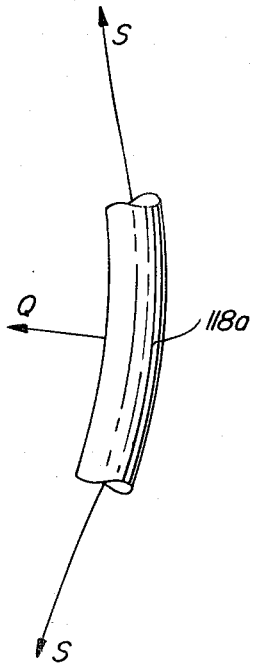

FIGS. *7a* and *7b* are, respectively, a partial side elevation and a sectioned plan view of guides for multiple wires present in the print head of FIG. 1;

FIG. 8 is a plan view of a back-stop member forming an element of the print head of FIG. 1;

FIG. 9 is a side elevation of a fixture for attaching the back-stop member of FIG. 8 to the magnet frame of FIGS. 2, 3 and 5; and FIGS 10*a* and 10*b* are, respectively, a partially sectioned, generalized side elevation of a portion of the print head illustrated in FIG. 1, showing a return or biasing member for the armature shown in that FIGURE and in FIG. 5, and a diagrammatic depiction of the forces produced by the return member.

DETAILED DESCRIPTION

There is illustrated in FIG. 1 a partially sectioned, side elevation of a print head 10 according to the present invention. The print head 10 is shown as selectively actuating twenty-four print wires 12, although the number of print wires 12 may be greater or lesser.

Due to the simplicity of the individual elements of the print head 10, the simplicity of assembling together these elements, the lack of critical adjustment or assembly steps, and the overall low material and labor costs thereof, the head 10 may conveniently contain twenty-four or more small diameter print wires 12 to produce clear, high quality indicia and characters without the need for the head to be passed over a line of indicia more than one time. Moreover, the number of elements of the head 10 is held to a minimum, and as a result thereof and of the overall simplicity of the head 10, the head 10 has low mass. This low mass makes it easy to rapidly move the head 10 over a printing medium (not shown) such as a sheet of paper in a printer (not shown) with the use of a low power motor (not shown) of reasonable size. Additionally, the head 10 is compact, and as a result does not "crowd" the printer.

Each print wire 12 is movable longitudinally leftwardly in FIG. 1 to impact one end 12P against an inked ribbon (not shown) which is held adjacent to the printing medium maintained on a surface such as a platen (not shown) in the printer. The wires are also movable back to the right, as depicted in FIG. 1, after the inked ribbon is impacted against. The leftward position of the print wires 12 is called the print position; the rightward position is called the non-print position. Movement of the print wires 12 is effected by moving driven ends 12D thereof.

In preferred embodiments of the present invention, the print head 10 is divided into a plurality of levels 10*a*, 10*b*, 10*c*, etc. Where the print head 10 contains twenty-four wires 12, each level 10*a*, 10*b*, 10*c*, etc. may selectively move eight print wires 12, although fewer or more wires 12 may be in each level 10*a*, 10*b*, 10*c*. As described in greater detail below, the present invention involves, among other things, convenient assembly of each level 10*a*, 10*b*, 10*c*, etc. and the convenient assembly together of the levels 10*a*, etc. to produce the print head 10. To the left of the print head 10, the print wires 12 may be guided by a wire guide 14, which does not, per se, constitute a portion of the present invention. The wire guide 14 may be constructed in accordance with the principles of the prior art.

Each level 10*a*, etc. of the print head 10 has elements and parts in common with other levels leading to economy of fabrication. Other than the wire guide 14, only two parts or elements are not common to all levels 10*a*, etc., as described in greater detail below.

Each level 10*a*, 10*b*, 10*c*, etc. of the print head 10 includes a magnet frame 16. Referring to FIGS. 1–3 and 5–6, the magnet frame 16 may be seen to comprise a generally cup-shaped member 18. The cup-shaped member 18 is made of a ferromagnetic material and may be formed from milled stock, but is preferably formed from sintered powder. The cup-shaped member 18 includes a bottom wall 20 and an upstanding lip or side wall 22, which together define an interior cavity 24. The lip or side wall 22 has a planar free surface. The bottom wall 20 contains a central aperture 26, for a purpose to be described below, and surrounding the central aperture 26 are two pair of holes 28 and 30. The holes 28, which are oppositely located on a diameter of the aperture 26, are tapped for a purpose to be described below. The other holes 30, which are located on a diameter of the aperture 26 which is rotated approximately 67½° from the diameter on which the holes 28 are located, are untapped for a purpose to be described below.

Located away from the aperture 26 and closer to the lip or side wall 22 of the cup-shaped member 18 are a plurality of poles 32. The poles 32, which are made of a ferromagnetic material, may be formed integrally with or attached to the bottom wall 20 of the cup-shaped member 18. Where the cup-shaped member 18 is formed from milled stock, the poles 32 may, if convenient, be formed by the same or a separate milling operation. Where the cup-shaped member 18 is formed from sintered powder, the poles 32 may be similarly formed at the same time intergrally therewith or may be formed from milled stock and later attached as convenient to the bottom wall 20. It is important that the magnetic impedance between the poles 32 and the cup-shaped member 18 be as low as possible and any prior art technique ensuring this result may be used.

The poles 32 are evenly spaced around the aperture 26 within the cavity 24 of the cup-shaped member 18. In preferred embodiments of the present invention, where each level 10*a*, 10*b*, 10*c*, etc. actuates eight print wires 12, each cup-shaped member 18 carries eight poles 32 spaced 45° apart. Two of the poles 32 are oppositely spaced on the same diameter as the untapped holes 30, while the tapped holes 28 are located on a diameter between two adjacent diameters on which two other pairs of poles 32 are located. Each pole 32 contains a planar pole face 34, which faces away from the bottom wall 20 and is coplanar with the planar free surface of the lip or side wall 22.

Preferably, portions of the lip or side wall 22 extend inwardly and more or less radially toward the aperture 26 between adjacent poles 32. Specifically, each pole 32 is preferably partially coaxially surrounded by a pair of tapered inward extensions 36 having planar free surfaces coplanar with the free surface of the lip 22 and the pole face 34. The tapering of the extensions 36 may be viewed either from a perspective generally parallel to the side wall 22, wherein the tapering decreases from the side wall 22 toward the aperture 26, or, from a perspective generally perpendicular to the side wall 22, wherein the tapering decreases along the side wall 22 to either side of each pole 32. In the first perspective, the thinnest portion of each extension 36 is at the side wall 22 and the thickest portion is in the inwardmost terminus. In the second case, the thickest portion of each extension 36 is at the intersection of the side wall 22 with a diameter of the cavity 24 on which each pole 32 is located, while the thinnest portion is at the intersection of each extension 36 (or the portion of the side wall 22 forming same) with a diameter of the cavity 24 between adjacent poles 32. Thus, there is defined between each pole 32 and the inward extensions 36 of the lip or side wall 22, a circular subcavity 38, each of which is contiguous with the cavity 24. As a consequence, each pole 32 is partially surrounded (preferably in excess of 180°) by the ferromagnetic metal of the inward extensions 36. As shown at FIG. 2, the sub-cavities 38 may be generally cylindrical. The purpose of the extensions 36 is explained below The lip 22 of the cup-shaped member 18 contains a plurality of notches 40. Each notch 40 is located on a diameter of the aperture 26 and is formed in the lip 22 to the outside of its associated pole 32 relative to the aperture 26. The notches extend downwardly through the lip 22 toward the bottom wall 20 and may have the rectangular configuration depicted.

Referring to FIG. 3, which shows the magnet frame 16 from the underside, the cup-shaped member 18 may also include a plurality of spacing posts 42. The spacing posts 42 extend away from the outside surface of the bottom wall 20, and may, as shown in FIG. 3, be four in number, spaced equally apart. As depicted in FIG. 3, the tapped holes 28 formed in the bottom wall 20 of the cup-shaped member 18 need not extend completely therethrough.

Figure 4:
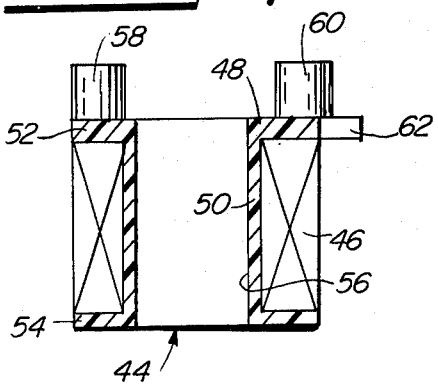
FIG. 4 is a sectioned, side elevation of a bobbin and coil mounted to the magnet frame of FIGS. 2 and 3.

Referring now to FIGS. 1 and 4, around each pole 32 there is positioned a bobbin 44, having wound thereabout an electric coil 46. Each bobbin 44 preferably comprises a molded plastic member 48, which may include an elongated, tubular portion 50 and a pair of integral, parallel flange portions 52 and 54. The tubular portion 50 contains a central aperture 56 which is capable of being slid over and held by a pole 32. The outside configuration and size of each pole 32 is just slightly smaller than the inside size and configuration of its associated aperture 56 so that each bobbin 44 may be conformally slid over its pole 32 and conformally retained in its subcavity 38. As already noted, the bobbins 44 are preferably molded, and the flanges 52 and 54 are preferably formed integrally with the tubular portion 50. The coil 46 is wound about the tubular portion 50 in any well-known manner between the flanges 52 and 54.

As viewed in FIG. 4, the lower flange 54 of the bobbin 44 defines a generally circular planar member. The upper flange 52 is similar, but has additional features thereon. Referring to FIGS. 1, 4, and 5, the upper flange 52 of each bobbin 44, as viewed in FIG. 4, carries thereon a pair of guide posts 58 and 60, which are preferably formed integrally therewith when the bobbin 44 is molded. The guide posts 58 and 60 may be circular in cross-section. If preferred, the guide posts 58 and 60 may have square or rectangular cross-section. The guide posts 58 and 60 are diametrically opposed relative to the aperture 56, the guide posts 58 being referred to as a forward guide post, and the guide post 60 being referred to as a rearward guide post. The guide posts 58 and 60 serve a funtion to be hereinafter described. Also, preferably integrally formed when the bobbin 44 is molded is a locating tab 62, which is adjacent the rearward guide post 60. The posts 58 and 60 and the tab 62 are all located on a diameter of the aperture 56. The locating tabs 62 have a size and shape complementary to the notches 40 formed in the lip 22 of the magnet frame 16. In this way, when each bobbin 44 is slipped over its associated pole 32, the locating tabs 62 may be positioned to fit into the notches, as shown in FIG. 5, to hold the bobbins 44 with the coils 46 thereon against rotation. This positioning of the bobbins 44 on the poles 32 also locates the guide posts 58 and 60 on a diameter of the aperture 26. The guide posts 58 and 60 are so located that the forward guide posts 58 is closer to the aperture 26, while the rearward guide post 60 is closer to the lip 22 of the cup-shaped member 18.

Continuing to refer to FIG. 5, it may be seen that, following the mounting of each bobbin 34 with its cell 46 thereabout on its pole 32, there is then associated with each pole 32 an armature 64. Each armature 64 is a generally planar ferromagnetic member having a rather broad base 66, and a substantially narrower finger 68 integral with the base 66. As will hereinafter be described in detail, the armature 64 pivots about its base 66, which is also selectively attracted by its associated pole 32 and extensions 36 when the coil 46 is energized, while the finger 68 bears against and selectively moves the end 12D of its associated print wire 12. The armatures 64 may conveniently be stamped from flat stock.

Each armature 64 contains a pair of holes 70 and 72. The hole 70 is termed a forward hole, and the hole 72 is referred to as a rearward hole. The holes 70 and 72 are oriented and located so as to be engageable by, respectively, the guide posts 58 and 60, as shown in FIG. 5, with the forward guide posts 58 being located within and engaging the forward holes 70 and the rearward guide posts 60 being located within and engaging the rearward holes 72. The purpose of the guide posts 58 and 60 engaging the holes 70 and 72 is to permit each armature 64 to pivot, while preventing such armature 64 from rotating or from becoming disassociated from its associated pole 32, bobbin 44, and coil 46. To facilitate pivoting of the armatures 64, the forward hole 70 may be elongated as shown. The holes 70 and 72 have shapes complementary to the cross-section of the guide posts 58 and 60. Rectangularly cross-sectioned guide post 58 and 60 and complementary holes 70 and 72 may be used to increase the guiding surface area and to minimize wear of both thereof due to pivoting of the armatures 64.

As can be seen in FIG. 5, the base 66 of each armature 64 has a substantial lateral extent whereby its associated pole 32, its associated segment of the lip 22, and its associated inward extensions 36 on either side thereof, are overlain by such base 66. The finger 68 of each armature 64 extends to, and over, the edge of the aperture 26 so that, when all the armatures 64 of a given level 10*a*, 10*b*, 10*c*, etc., are positioned over their guide posts 58 and 60, a circular array of the fingers 68 about the aperture 26 is formed. The fingers 68 of the circular array each drive the end 12D of a print wire 12 extending through the aperture into abutment therewith. As can also be seen in FIG. 5, the holes 28 reside laterally between adjacent fingers 68 of adjacent armatures 64 while the holes 30 reside directly below the finger 68 of a superjacent armature 64, both for a purpose to be described below. Further, as seen in FIG. 5, the base 66 of each armature 64 contains nearly semi-circular cutouts 74 for a purpose to be described below.

Figure 6:
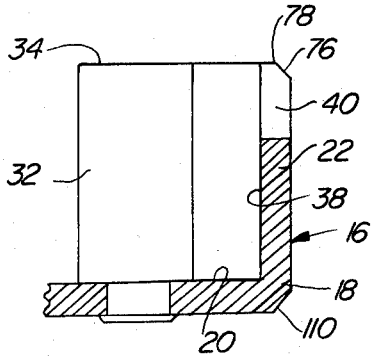
FIG. 6 is a sectioned, side elevation of a portion of the magnet frame of FIGS. 2, 3 and 5 taken along line 6—6 in FIG. 5.

Referring now to FIGS. 5 and 6, it may be seen that, at the location of each armature 64 arrayed about the magnet frame 16 (when the holes 70 and 72 are engaged by the guide posts 58 and 60) a bevel 76 is formed in the outside edge of the lip or side wall 22 of the cup-shaped member 16. Each bevel 76 is formed at one thinnest portion of the side wall 22 (between adjacent extensions 36) as an angular flat surface and includes a straight edge 78, which lies directly beneath the base 666 of its associated armature 64. The edge 78 of each bevel 76 serves as a pivoting edge or pivoting line for its associated armature 64. As shown in FIG. 1, and partially in FIG. 5, each level 10*a*, 10*b*, 10*c*. etc. includes a magnet frame 16 with its plurality of poles 32 and a plurality of bobbins 44, each with a coil 46 thereon, positioned around each pole 32. Further, each pole-bobbin pair 32,44 has associated therewith an armature 64. The levels 10*a*, 10*b*, 10*c*, etc. are attached together in a manner to be now described.

A back plate 80 of the print head 10 (shown in FIG. 1) contains a pair of holes 82 (only one is shown in FIG. 1), through each of which an elongated screw 84 may be inserted. The screws 84 inserted through the holes 82 in the back plate 80 are turned into the tapped holes 28 formed in the bottom wall 20 of the magnet frame 16 of the rightwardmost level 10*c* in FIG. 1. Thus, the backplate 80 is mounted to the first level 10*c*. The shafts of the screw 84 pass between the spaced fingers 68 of two pairs of adjacent armatures 64 in the level 10*c* so that pivoting of the respective armatures 64 is not interferred with.

The level 10*c* is attached to the level 10*b* by inserting into the untapped holes 30 in the bottom wall 20 of its magnet frame 16 another pair of screws 84. These screws 84 are turned into the tapped holes 28 formed in the bottom wall 20 of the magnet frame 16 of the level 10*b*. Again, the shafts of the screw 84 do not interfere with the armatures 64 of the level 10*b* in the manner described above. In the same manner, the level 10*b* is attached to the level 10*a*. The untapped holes 30 in the bottom wall 20 of the magnet frame 16 of the level 10*a* may hold screws 86, which mount the wire guide 14 to the left end of the print head 10 via a collar 87 thereon. In the actual assembly of the print head 10, as depicted in FIG. 1, the levels 10*a*, 10*b*, 10*c*, etc. are attached to each other in the reverse order described above. Specifically, the level 10*a* has attached thereto the wire guide 14 after which the level 10*b* is attached to the level 10*a*. Following this, the level 10*c* is attached to the level 10*b*, after which the back plate 80 is attached to the level 10c. Since the tapped and untapped holes 28 and 30 in adjacent levels 10a, etc. are offset 67½° about the axis of the head 10, the print wires 12 of each level may be easily prevented from interfering with those of adjacent levels.

As can be seen from FIG. 1, each print wire 12 may include a button head 88 mounted on the end 12D thereof and, surrounding both the print wire 12 and the button head 88, a short coil spring 90. The coil springs 90 are intended to normally maintain their associated print wires 12 in their non-print position with the ends 12D against the fingers 68 of their armatures 64 by acting between the button head 88 and a wire guide member 92a, 92b, 92c associated with each level 10a, 10b, 10c, as described hereinafter.

Figures 7A, 7B:
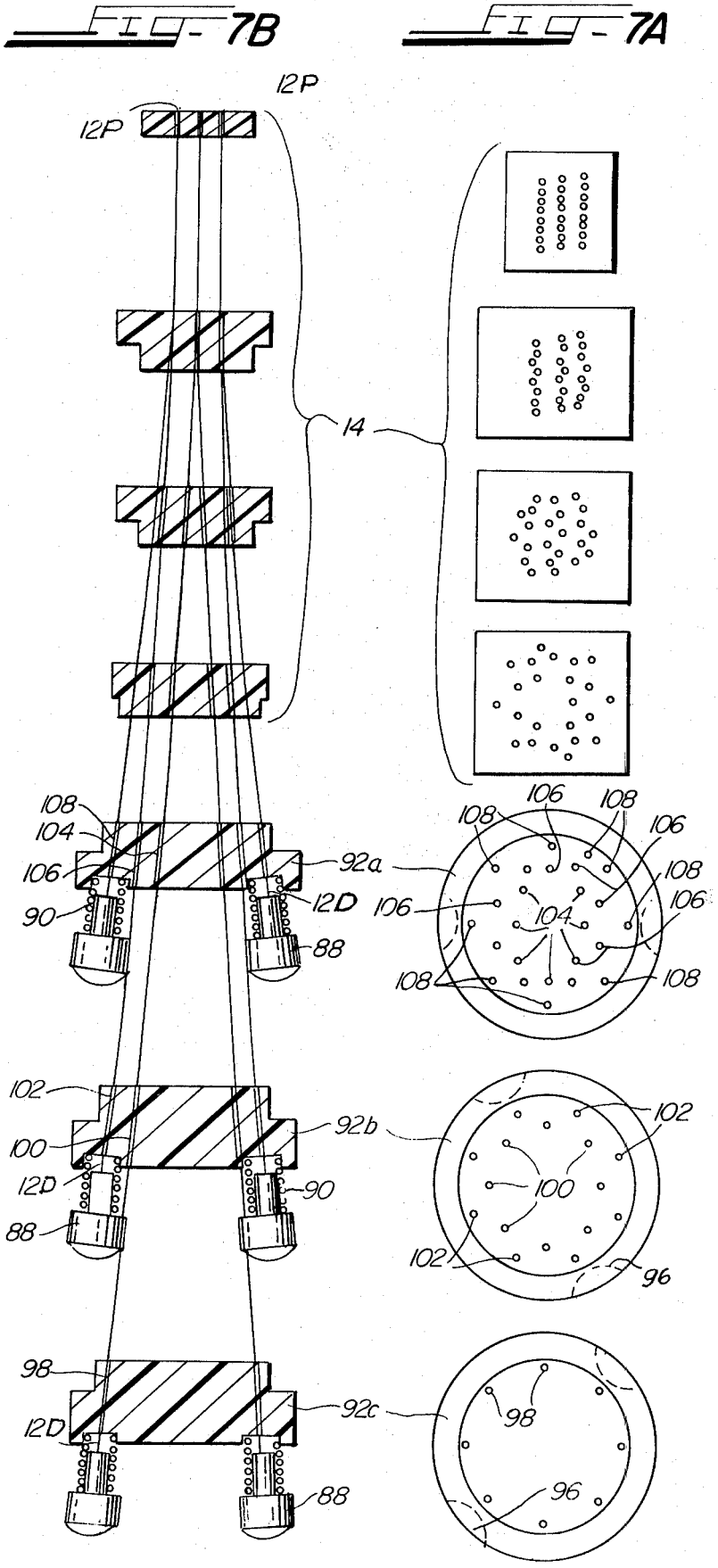

Each wire guide member 92a, etc. is a generally circular, preferably plastic member, which may be held against a raised lip 94 surrounding the aperture 26 by the springs 90 or in any other convenient manner, such as by the screws 84 and 86. Where the springs 90 are used to achieve this end, the guide members 92 may contain cutouts 96 via which the heads of the screws 84 and 86 may "key" the members 92 into a proper position. As shown in FIG. 7, each wire guide member 92a, 92b, and 92c has a different hole pattern formed therethrough. The hole pattern in the wire guide 92c comprises eight holes 98 in a generally circular array. The wire guide member 92b contains two arrays 100 and 102 of eight holes each, the array 100 being inward of the array of holes 102. Lastly, the wire guide member 92a contains three arrays 104, 106 and 108 of eight holes each, the array 104 being innermost, the array 108 being outermost, and the array 106 being therebetween. Referring to FIGS. 1 and 7, the print wires 12 driven by the armatures 64 in the level 10c pass through the holes 98 in the wire guide member 92c, through the innermost array 100 of holes in the wire guide member 92b and through the innermost array 104 of holes in the wire guide member 92a. Similarly, the print wires 12, selectively moved by the armatures 64 in the level 10b, pass through the outermost array 102 of holes in the wire guide member 92b and through the central array 106 of holes in the wire guide member 92a. Lastly, the print wires 12, operated by the armatures 64 in the level 10a, pass through the outermost array 108 of holes in the wire member 92a.

The coil springs 90 act between the wire guide members 92 and the button heads 88 to maintain the print wires 12 in their normal non-print position, as shown in FIG. 1. The holes 98,102,108 in the wire guide members 92 may be counterbored to accept the left ends of the springs 90 for positioning thereof and for maintaining the button heads 88 against the fingers 68 of their associated armatures 64.

The exterior juncture between the lip or side wall 22 and the bottom wall 20 of each magnet frame 16 may be beveled, as shown at 110. As the print head 10 is depicted in FIG. 1, the bevels 110 of all but the leftwardmost level 10a are used in the following fashion. Surrounding each magnet frame 16 about the bevel 110, as well as the adjacent portions of the bottom wall 20 and the lip portion 22, may be a ring or annular member 112. The ring 112 includes a beveled surface 114 which serves a function described below. The back plate 80 also includes a beveled surface 116 similar to the beveled surface 114 on the rings 112. The beveled surfaces 114 and 116 are generally parallel to each other and may be formed at a convenient angle, such as approximately 45° relative to the axis of the apertures 26 of the assembled levels 10a, 10b, 10c, etc. of the print head 10. Each ring 112 may include cut-outs (not shown) to accommodate the spacing posts 42.

When the print head 10 is assembled, as shown in FIG. 1, around each bevel 114 and 116 is positioned in tension a rubber or other elastomer band or O-ring 118. Each band or O-ring 118 is so positioned as to be trapped between, and to simultaneously rest against, its associated bevel 114 or 116 and the back surface of each armature 64 in its level 10a, etc. across the base 66 thereof. Thus, as shown in FIG. 1, each band or O-ring 18 is trapped between its associated bevel 114 or 116 and the associated armatures 64 in its level 10a, 10b, 10c, etc. Since the bands or O-rings 118 are in tension, and since each band or O-ring 118 is prevented from rolling inwardly due to the spacing between its bevel 114 or 116 and its associated armatures 64, each band or O-ring 118 applies a generally normal force to its associated armatures 64 and another force generally normal to its associated beveled surface 114 or 116, as shown in FIGS. 10a and 10b.

As shown in FIG. 10a, each O-ring 118 is trapped between the bevels 114 or 116 of the levels 10a, 10b, 10c, etc. and the base 66 of the associated armatures 64. Referring to FIG. 10b, and considering a section 118a of the O-ring 118 which covers the base 66 of an armature 64, the tension in the stretched O-ring 118 may be represented by opposed forces S which produce a resultant force Q. The force Q may be considered as producing two force components N and F, FIG. 10a. The force F acts normally against the armature base 66 a distance A away from the pivoting edge or pivoting line 78. This force F both holds the armature 64 against the pivoting edge or pivoting line 78 and produces a torque (F) x (A) which normally biases the armature 64 to its non-print position. The magnituge of the force F may be varied by varying the cross-section, circumference, elasticity, and constituents of the O-ring 118 and by varying the angle $\alpha$ of the bevels 114 or 116.

The force N exerted by each O-ring 118 on its beveled surface 114 or 116 holes it in place and maintains it in tension, while the force F applied to its associated armature 64 maintains the armature 64 in its normal non-print position as depicted in FIGS. 1 and 10a. Specifically, the force applied by the O-rings 118 to their associated armatures 64 normally maintains each armature 64 pivoted to the right, as shown in FIG. 1, and against the pivoting edge or pivoting line 78 associated with each armature 64. The force F applied to each armature 64 by its associated O-ring 118 is in aid of the force applied by each coil spring 90 between its button head 88 and the wire guide member 92. Thus, the coil springs 90 and the O-rings 118 may act in conjunction to maintain each armature 64 in its normal non-print position depicted in FIG. 1. Accordingly, it may be seen that by the simple expedient of the use of the rubber O-rings 118 and the beveled surfaces 114 and 116, the armatures 64 may be all similarly biased by generally similar forces to their non-print positions. As should be apparent, no special skill is required in placing the O-rings 118 in position and, once the O-rings 118 are so placed, all of the armatures 64 are biased by similar forces F to their non-print positions by the co-action of the tension S in the O-rings 118 and the forces N and F applied thereby between the beveled surfaces 114 and 116 and the bases 66 of the armatures 64.

Referring now to FIGS. 1, 8 and 9, a plurality of back-stops 120*a*, 120*b*, and 120*c* are provided for setting the non-print position of the armatures 64. As shown in side cross-section in FIG. 1 and in FIG. 8, the back-stops 120*a*, 120*b* and 120*c* may each comprise a rubber disk 122 having a central aperture 124 and a plurality of equally-spaced diametric slots 126. Two diametrically opposed slots 126 are enlarged, as at 128, to permit the passage through the disk 122 of the shanks of the screws 84. The number of slots 126 corresponds to the number of armatures 64 in a given level 10*a*, 10*b*, 10*c*, etc., and adjacent slots 126 define therebetween back-stop segments 130.

The disks 122 are adhered respectively to the left outside surface of the magnet frames 16 for the levels 10*b* and 10*c*, and one rubber disk 122 is adhered to the left surface of the back plate 80. The disks 122 are adhered to their respective surfaces by a quantity of cement or glue 132. One back-stop segment 130 of each disk 122 is aligned with, and is abutted by, the rightward surface of its respective armature 64 when that armature 64 is in its non-print position.

As best shown in FIG. 1, the rubber disks 122 are cemented to their respective surfaces so that the segments 130 are angularly related relative to the axis of the print head 10. Specifically, this angular relation of the back-stop segments 130 is such that the leftward surface of the segments 130 is located at the angle assumed by its respective armature 64 when that armature 64 is in its non-print position.

In order to simplify attachment of the disks 122 to their respective surfaces, so that the back-stop segments 130 have the proper angular relationship, a fixture 134, shown in FIG. 9, is provided. The fixture 134 includes an upper member 136 having a surface 138, which is sloped at the required angle. The spacing posts 42 of each magnet frame 16 may be rested on a surface 140 of the fixture 134 located to the side of and below the upper member 136. The height of the upper member 136 is selected so that, when the spacing posts 142 rest on the surface 140, a rubber disk 122, previously "roughly" adhered with a quantity of the cement 132 to the magnet frame 16, has its segments 130 pressed and held in the required angular relationship. The magnet frame 16 is permitted to reside on the fixture 134 until the cement 132 sets, after which the magnet frame 16 may be used to assemble a level 10*a*, 10*b*, or 10*c* of the print head 10, as previously described. Although not shown in the FIGURES, the back plate 80 contains posts similar to the spacing posts 42, and the rubber disk 122 is adhered thereto in a similar manner.

When the print head 10 is assembled, the spacing posts 42 of all but the leftwardmost level 10*a* rest against the inwardly extending portion 36 of the lip 22 of the leftward cup-shaped member 18 between the cutouts 74 formed in the armatures 64. This positioning of the posts 42 prevents their interfering with the free pivoting of the armatures 64 and spaces the levels 10*a*, 10*b*, and 10*c* apart.

Since certain crucial relationships of the elements of the head 10 are automatically maintained and require little skill to achieve, the print head 10 is quite simple and inexpensive to assemble. Specifically, since the armatures 64 may be stamped parts and are located for pivoting by the guide posts 58 and 60 formed integrally with the bobbins 44, no adjustment or complicated assembly is required to assemble the armatures 64 with their respective bobbins 44. The locating tabs 62 automatically orient and position their bobbins 44 and, accordingly, orient and position the armatures 64 mounted to the posts 58 and 60 thereon. Further, as already explained, because of the presence of the beveled surfaces 114 and 116 and the convenient use of the tensioned rubber O-rings 118 to provide return force to the armatures 64, no delicate spring adjustments or similar adjustments are required. The proper angular relationship of the back-stop segments 130 is achieved by means of the use of the fixture 134 and, again, no complicated adjustment is required. Additionally, except for the back plate 80 and the wire guide members 92, all the levels 10*a*, 10*b* and 10*c* contain the same number of similar parts, similarly assembled.

The compactness and simplicity of the head 10 is utilized to further advantage in associating printed circuit boards 142 therewith. The magnet frame 18 of each level 10*a*, 10*b* and 10*c* may be surrounded by and have mounted thereto in any convenient manner an associated board 142 (FIG. 1). To this end, the boards 142 may each contain a central aperture 144 which fits over the magnet frame 18. The boards may carry conductors (not shown) and electrical components (not shown) used to selectively energize the coils 46 and selectively move the print wires 12 to their print positions.

In addition to the low cost and simplified construction of the head 10, such also offers improved operation. First, the screws 84 accurately mount the levels 10*a*, 10*b*, 10*c*, etc. a selected distance apart due to the engagement of the spacing posts 42 of one magnet frame 18 with extensions 36 of the lip 22 of the leftwardly adjacent magnet frame 18. This accurate mounting, and the precise positioning and angular orientation of the back-stops 120, achievable through the use of the fixture 134, result in each armature 64 in its non-print position being similarly pivotally related to the axis of the head 10 and being spaced the same amount from the pole face 34 of its associated pole 32. This similar spacing is further ensured by the O-rings 118 which similarly bias each armature 64 to its non-print position. As a consequence, each armature 64 is movable to its print position by approximately the same amount of force applied thereto by its pole 32 and extensions 36 upon energization of its coil 46. Further, each armature 64 pivots the same amount on its pivoting edge or pivoting line 78 in moving its print wire 12 to the print position.

Second, as described in the '368 patent, because the bases 66 of the armatures 64 overlie both their associated pole faces 34 and extensions 36, the efficiency of magnetic flux in pivoting the armatures 64 when their coils 46 are energized is increased. When any coil 46 is energized, flux exists in the gap between the base 66 of the associated armature 64 and both the pole face 34 and the coplanar surfaces of the extension 36 on either side of the pole 32. Flux also exists in the gap between the base 66 and the portion of the lip 22 immediately adjacent the pivoting edge 78. This construction has the effect of effectively enlarging the "working pole faces'-'—the pole face 34 and the surfaces of the extensions 36—in the sense that the flux has a greater cross-sectional area over which to do useful work with respect to the extensions 36 and the armature 64. Little, if any, useful work can be done by flux in the vicinity of the pivoting edge 78. Thus, the present construction increases the efficiency of the magnetic circuit—the armatures 64, the poles 32, and the extension 36 of the magnet frame 18—without unduly increasing the mass of these elements. In each level 10*a*, 10*b*, 10*c*, etc., each armature 64 is associated with two magnetic circuits, one through each extension 36 overlain by the base 66 and the pole 32. Since the portion of the lip 22 near the pivoting edge 78 can contribute little to movement of the armature 64, it can be "cut away," as shown, due to the formation of the subcavities 38.

Third, the armatures 64 have been configured to increase the efficiency of their pivoting. The bases 66 thereof are increased in width to efficiently magnetically couple them to the poles 32 and to the extensions 36 of the magnet frame 16. The fingers 68 which play little part in the magnetic circuit are narrowed, thereby decreasing the mass of the armatures 64 to ensure that they can be rapidly pivoted.

I claim:

1. An actuator for a print wire having a printing end and a driven end, the wire being movable between non-print and print positions by the actuator, which comprises:

a ferromagnetic magnet frame which includes a bottom wall, a side wall extending away from the bottom wall, and a ferromagnetic pole extending away from the bottom wall in the same direction as the side wall; the side wall having a pair of inward extensions which extend along the bottom wall away from the side wall and towards points to either side of the pole; the thickness of the inward extensions varying along a direction generally perpendicular to the side wall; the inward extensions each having a lateral surface so shaped that a cavity is produced between the pole and the extensions, a wall of which cavity is at all points substantially equidistant from the pole; the side wall having a top planar surface co-planar with the top face of the pole and with the top surfaces of the extensions; the top planar surface of the side wall being formed with a bevel at that part of the outer edge of the side wall which is the thinnest portion of the inward extensions, the innermost part of the bevel and the surface of the side wall defining a pivoting edge;

a planar ferromagnetic armature having opposed first and second surfaces and having a wide base and a substantially narrower finger which is abuttable with the driven end of the print wire; said pivoting edge defining a pivot line about which the base of the armature is pivotable between a non-print and a print position with the finger to the inside of the pivoting edge; the first surface of the base of the armature being pivoted on the pivoting edge so that the first surface of the armature overlies the co-planar surfaces of the side wall and the extensions and the pole face, that portion of the first surface of the armature inward from the pivoting edge being separated from the co-planar surfaces and from the pole face in the non-print position of the armature and contacting said co-planar surfaces and the pole face in the print position thereof;

an insulative bobbin with a selectively energizable electric coil thereon surrounding the pole and generally conformally held in the cavity;

means for holding the first surface of the armature at the base against the pivoting edge; and means for biasing the armature to its non-print position;

whereby energization of the coil pivots the armature on the pivoting edge against the biasing means due to attraction thereof by the co-planar surfaces and the pole to effect movement of the finger and of the driven end of the print wire so that the printing end of the print wire is impacted against a printing medium, the configuration of the extensions thereby serving to maximize the effect of the attractive force on the armature by maximizing the size of the co-planar surfaces overlain by the first surface of the armature while minimizing the size of the surface of the size wall in the vicinity of the pivoting edge.

2. An actuator as in claim 1, wherein:

the holding means and the biasing means comprise a beveled surface angularly related to the print position of the armature and spaced from the second surface of the armature at the base, and a tensioned elastomeric band trapped between the beveled surface and the second surface of the armature at the base, the band contacting the second surface of the armature at the base to the outside of the pivoting edge, the tension in the trapped band effecting the application of a resultant force generally normal to the second surface.

3. An actuator as in claim 1, which further comprises:

a resilient member angularly related to the print position of the armature and abuttable by the second surface of the armature at the finger to the inside of the pivoting edge in, and thereby setting, the non-print position of the armature.

4. An actuator as in claim 3, wherein:

the holding means and the biasing means comprise a supporting surface mounting the resilient member, a beveled surface which is angularly to the armature, formed in the supporting surface, and spaced from the second surface of the armature at the base, and a tensioned elastomeric band trapped between the beveled surface and the second surface, the band contacting the second surface of the armature at the base to the outside of the pivoting edge, the tension in the band effecting the application of a resultant force generally normal to the second surface to normally abut the second surface against the resilient member.

5. An actuator as in claim 1, which further comprises:

a notch formed in the thinnest portion of the extensions, and a locating tab integral with or attached to the bobbin and held in the notch for locating the bobbin, and preventing movement of the bobbin, in the cavity.

6. An actuator as in claim 5, which further comprises:

means on the bobbin for preventing relative movement between the bobbin and the armature other than pivoting of the armature on the pivoting edge.

7. An actuator as in claim 6, wherein:

the preventing means comprises a pair of posts on the bobbin, and a pair of holes through the armature, each hole engaging one post, the action of the posts on the holes and the action of the notch on the tab preventing all relative motion among the bobbin, the armature, and the magnet frame except for pivoting of the armature on the pivoting edge.

8. An actuator as in claim 7, wherein:

the surfaces of the armature are symmetrical, the holes and the posts lie on the axis of symmetry of the armature with one of each thereof being closer to the edge than the other hole and post, the pivoting edge intersects and is normal to the axis of symmetry, and the hole farther from the pivoting edge to the inside thereof is elongated to permit pivoting of the armature on the pivoting edge.

9. An actuator as in claim 7, wherein:

the bobbin includes an upper flange, and the tab and the posts are integral with or connected to the upper flange.

10. A print head level including a plurality of actuators as in claim 9 for a plurality of print wires, wherein:

each of the armatures is associated with a magnet frame, a bobbin, a coil, holding means, and biasing means;

the magnet frames are integral to form a common cup-shaped magnet frame having a common bottom wall, and a continuous integral side wall having a plurality of extensions, with adjacent armatures overlying or contacting shared extensions therebetween;

the cavities are continuous with each other and form a main cavity within the common magnet frame;

the main cavity communicates with a central aperture formed in the common bottom wall;

the fingers of the armatures overlie the central aperture in an spaced array thereabout; and the print wires extend through the central aperture into abutment with their respective fingers.

11. A print head level as in claim 10, wherein:

the holding means and the biasing means comprise:

a beveled surface angularly related to the armatures and spaced from the second surfaces of the armatures at the bases thereof; and a tensioned elastomeric band trapped between the beveled surface and the second surfaces, the band contactng the second surfaces of the armatures at their bases to the outside of the pivoting edges, the tension in the band effecting the application of similar resultant forces generally normal to each second surface.

12. A print head level as in claim 10, which further comprises:

a resilient member having segments angularly related to the print positions of the armatures and abuttable by the second surfaces of the armatures at the fingers to the inside of the pivoting edges in, and thereby setting, the non-print positions of the armatures.

13. A print head level as in claim 12, wherein:

the holding means and the biasing means comprise a supporting surface mounting the resilient member, a beveled surface which is angularly related to the armatures, formed in the supporting surface, and spaced from the second surfaces of the armatures at the bases thereof, and a tensioned elastomeric band trapped between the beveled surface and the second surfaces, the band contacting the second surfaces of the armatures at the bases to the outside of the pivoting edges, the tension in the band effecting the application of similar resultant forces to each second surface to normally abut each second surface against its associated segment.

14. A print head which includes a plurality of the print head levels as in claim 13, which further comprises:

means for mounting the levels together with their central apertures aligned, the print wires of each level passing through and along one or more of the aligned central apertures.

15. A print head as in claim 14, wherein:

except for the level closest to the printing ends of the print wires, the supporting surfaces constitute the exterior of the common bottom wall of the adjacent level farther from the printing ends and the beveled surfaces constitute a bevel in the exterior of the common bottom wall of the magnet frame of the adjacent level farther from the printing ends, and which further comprises a back plate facing the level farthest from the printing ends, the back plate having a supporting surface and a beveled surface, the supporting surface carrying an elastomeric member, segments of which set the non-print positions of the armatures of such farthest level, a tensioned elastomeric band being trapped between the bevel and the second surfaces of the armatures of such farthest level to bias such armatures to their non-print positions.

16. A print head as in claim 15, which further comprises opposed cutouts in the base of each armature, the cutouts lying on a line which is perpendicular to the axis of symmetry of the armature, a plurality of spaced posts on and extending away from the exterior of the common bottom wall of each common magnet frame and from the back plate, the posts being located so as to rest against the surfaces of respective extensions of an adjacent level closer to the print ends between the cutouts of adjacent armatures in such adjacent level, and wherein the mounting means comprises fasteners insertable through the plate or through the common bottom wall of the levels and attachable to the common bottom wall of the next adjacent level closer to the print ends, the fasteners passing between the fingers of adjacent armatures in such adjacent level.

17. A print head level including a plurality of actuators as in claim 1 for a plurality of print wires, wherein:

each of the armatures is associated with a magnet frame, a bobbin, a coil, holding means, biasing means, and maintaining means;

the magnet frames are integral to form a common cup-shaped magnet frame having a common bottom wall, and a continuous integral side wall having a plurality of extensions with adjacent armatures overlying or contacting shared extensions therebetween;

the cavities are continuous with each other and form a main cavity within the common magnet frame;

the main cavity communicates with a central aperture formed in the common bottom wall;

the fingers of the armatures overlie the central aperture in an equally spaced array thereabout; and the print wires extend through the central aperture into abutment with their respective fingers.

18. A print head level as in claim 17, wherein:

the holding means and the biasing means comprise:

a beveled surface angularly related to the armature and spaced from the second surfaces of the armatures at the base thereof; and a tensioned elastomeric band trapped between the beveled surface and the second surfaces, the band contacting the second surfaces of the armatures at their bases to the outside of the pivoting edges, the tension in the band effecting the application of similar resultant forces generally normal to each second surface.

19. A print head level as in claim 18, which further comprises:

a support surface on which the beveled surface is formed; and a resilient member carried by the support surface and having segments angularly related to the print positions and the armatures and abuttable by the second surfaces of the armatures at the fingers to the inside of the pivoting edges in, and thereby setting, the non-print positions of the armatures.

20. A print head which includes a plurality of the print head levels as in claim 19, which further comprises:

means for mounting the levels together with their central apertures aligned, so that except for the level closest to the printing ends of the print wires, the supporting surfaces constitute the exterior of the common bottom wall of the adjacent level farther from the printing ends and the beveled surfaces constitute a bevel in the exterior of the common bottom wall of the magnet frame of the adjacent level farther from the printing ends, the print wires of each level passing through one or more of the aligned central apertures; and a back plate facing the level farthest from the printing ends, the back plate having a supporting surface and a beveled surface, the supporting surface carrying an elastomeric member, segments of which set the non-print positions of the armatures of such farthest level, a tensioned elastomeric band being trapped between the bevel and the second surfaces of the armatures of such farthest level to bias such armatures to their non-print positions.

* * * * *